United States Patent [19]

Speranzin et al.

[11] Patent Number: 4,720,966

[45] Date of Patent: Jan. 26, 1988

[54] PROCEDURE FOR SPLICING YARNS

[75] Inventors: Claudio Speranzin; Roberto Badiali, both of Pordenone; Luciano Bertoli, Salo' all of Italy

[73] Assignee: Officine Savio S.p.A., Pordenone, Italy

[21] Appl. No.: 439,320

[22] Filed: Nov. 4, 1982

[30] Foreign Application Priority Data

Aug. 3, 1982 [IT] Italy ..... 83430 A/82

[51] Int. Cl.[4] ..... B65H 69/06; D01H 15/00

[52] U.S. Cl. ..... 57/22; 57/202; 57/261

[58] Field of Search ..... 57/22, 23, 202, 261-263

[56] References Cited

U.S. PATENT DOCUMENTS

| | | | |
|---|---|---|---|
| 1,345,375 | 7/1920 | Lemay | 57/22 |
| 2,028,144 | 1/1936 | Cavanagh | 57/22 |
| 2,362,801 | 11/1944 | Charnock | 57/22 |
| 2,515,172 | 7/1950 | Abbott | 57/22 |
| 2,605,603 | 8/1952 | Willis | 57/202 |
| 3,307,339 | 3/1967 | Porter | 57/22 |
| 3,379,002 | 4/1968 | Rosenstein | 57/202 |
| 3,633,352 | 1/1972 | Marriner | 57/22 |
| 4,240,247 | 12/1980 | Matsui et al. | 57/202 |

FOREIGN PATENT DOCUMENTS

| | | |
|---|---|---|
| 646976 | 8/1964 | Belgium . |
| 889501 | 11/1981 | Belgium . |
| 889502 | 11/1981 | Belgium . |
| 889503 | 11/1981 | Belgium . |
| 0039609 | 11/1981 | European Pat Off. . |
| 250226 | 8/1912 | Fed. Rep. of Germany . |
| 3029431 | 3/1982 | Fed. Rep. of Germany . |
| 3029452 | 3/1982 | Fed. Rep. of Germany . |
| 3114160 | 10/1982 | Fed. Rep. of Germany . |
| 5039A/79 | 9/1979 | Italy . |
| 376918 | 7/1932 | United Kingdom . |
| 661697 | 11/1951 | United Kingdom . |
| 2026555 | 2/1980 | United Kingdom . |

*Primary Examiner*—John Petrakes

*Attorney, Agent, or Firm*—Stevens, Davis, Miller & Mosher

[57] ABSTRACT

This invention relates to a procedure for splicing yarns, whether textile or otherwise, with a join made by coupling two single untwisted yarns and thereafter retwisting them, wherein the single yarns are untwisted beyond a substantially nil twist value and are then coupled and retwisted so as to impart to the single yarns a desired twist at least the same as the twist comprised in the original yarn, the untwisting phase being carried on beyond the nil value until a negative twist value has been imparted which is equal to at least 15-20% of the initial twist value comprised in the single yarn, and the value of the negative twist being at least in proportion to the desired reciprocal thrust induced between the yarns at least in the transitory phase when the fibers are parallel to the axis of the single coupled yarns during retwisting.

The invention also relates to a splice made by the above procedure.

15 Claims, 20 Drawing Figures

PROCEDURE FOR SPLICING YARNS

This invention relates to a new procedure for splicing yarns, whether textile or otherwise.

Joints made between textile yarns with fisherman's knots, weaver's knots or other kinds of knots are known.

Joints between yarns are also known which are made with adhesives or ties by winding yarn, outer silvers or fibers of the yarns themselves.

Joints are also known which are made by intertwining and entangling the fibers of the two yarns by blowing air or by means of electrostatic fields.

Joints made with these procedures entail drawbacks as regards the dynamometric properties, the ability to use the jointed yarn in usage devices downstream therefrom and the general properties of the joint.

Joints are also known which are made by untwisting the single yarns, uniting them and then twisting them together in the tract to be jointed.

The feature of the joints is coupling of two yarns and then twisting them together, having brought them beforehand into a condition where the fibers are almost parallel before coupling them together.

These joints provide unsatisfactory mechanical properties since the fibers of the original yarns do not cooperate mutually except to a small extent and in an inadequate way.

This leads to unsatisfactory strength, inadequate ability to reproduce the joints, imperfect end zones, and an unsatisfactory strength of the joint in the long term.

Attempts have been made to improve the joints by opening out and ruffling the fibers when the latter are substantially parallel. This has been done by using mechanical and/or pneumatic means, but without obtaining results which are appreciable or of a satisfactory level.

Piecers working with a jet or jets of air, for instance, thicken the fibers by matting them and stiffening the jointed tract, with a resulting loss of elasticity and also considerable problems for the usage devices downstream therefrom, particularly as regards dyeing and warping operations and other later operations.

The present invention has an object to provide a splice between yarns, whether textile or otherwise, which not only has good aesthetics features but also possesses mechanical, technological and elastic properties, an ability to be reproduced and a life which have never before been attained.

Furthermore, the invention has as an object to provide splices which are not only homogeneous in themselves but are also suitable for meeting the needs of varied usage means downstream therefrom.

Indeed it is possible that the splices can be individually made suitable for the type of usage means downstream by comprising middle and transition lengthwise sections of a kind and form selected as wished.

It is also an object of the invention to provide a procedure suitable for making splices of the aforesaid type.

According to the invention two single yarns are untwisted until a negative twist is obtained in them equal to at least 15–20% of the initial positive twist, but the negative twist may even reach 100% or more of the initial positive twist (as an example, if the initial twist of the yarn is an S twist, the negative twist will be a Z twist).

The minimum negative twist, however, will depend on the properties of the yarn and on how the yarn reacts in a procedure according to the invention, and also on the length of the joint.

To make clear the procedure, consider that the yarns initially have a Z twist.

After the untwisting operation both of the yarns have an S twist and the number of twists imparted per unit of length can be varied in relation to a plurality of factors as detailed earlier and as explained better hereinafter.

Next, the yarns are clamped in a coordinated manner and coupled together so as to be in mutual contact substantially, although not necessarily, along a generatrix in a tract of a set and suitable length.

The tract of length of mutual contact, however, will be related to the distribution of the lengths of the fibers and also the limit values of the length of the fibers.

As soon as the yarns have been coupled or else while the yarns are being coupled (in given conditions even before the coupling or during the retwist phase), the tail ends of the two yarns can be torn or plucked open or cut so as obtain small residual tails of the type and characteristics desired, perhaps even tapered progressively if such is wanted in relation to the properties of the final splice.

The cutting or plucking and/or tearing operations can also be performed before the coupling or at a time thereafter, for this is a phase of which the place in the procedure can vary in respect of the other phases without the results of the procedure being varied in most cases.

Steps are taken next to apply to the coupled yarns, in a tract approximately corresponding to that in which they are coupled, a retwisting action which tends to impart to the coupled yarns the same or more than the same twists (as regards quantity and direction) as were initially present in the single yarns.

This action of retwisting the coupled tract has the result that, starting from the time when the coupling takes place, the negative twist decreases in absolute value in the single yarns until an almost nil twist is obtained in them, that is, the fibers are positioned about parallel to the axis of the yarn.

As the retwisting action continues in the coupled tract, the retwisting action imparts to the single yarns a positive twist which may be smaller or greater than or the same as the initial twist in the single yarn.

In the tract wherein the single yarns are coupled, which will be considered to be the tract that will constitute the splice, starting with the parallel coupled yarns one obtains instead a progressive twisting action until a number of positive twists about the same as the number of twists imparted to the single yarns have been applied to the coupled tract.

During this retwisting, as the number of twists imparted to the coupled tract progresses, and therefore as the slope of the spiral (reduction of the pitch) formed by the two single yarns increases, the yarns tend to shrink lengthwise while they are being wound around each other.

For the purposes of tensile strength this reciprocal winding acts in the same way as the slope of the fibers acts in a single yarn leaving the spinning process.

This means that, when the splice formed undergoes traction, the slope of the spiral generates a centripetal thrust that clamps the underlying layers by friction.

An improvement in the properties of the splice can be obtained by opposing the axial shrinkage of the coupling with a braking or clamping action applied to the ends of the splice during the twisting phase.

During the retwisting this action of opposition to the axial shrinkage is translated into a stress within the coupled yarns.

Owing to the slope of the winding spiral this stress produces a reciprocal thrust between the two single yarns along the coupling zone in question and therefore between the fibers in the two yarns cooperating in the zone.

As a result the fibers are more greatly forced to cooperate or else at least to place themselves in intimate union in the zone of mutual contact.

According to the invention this action of induced reciprocal thrust is especially increased in worth during the intermediate twisting phase when the fibers of each of the two yarns forming the coupling reach an almost nil value of twist or are substantially parallel to the axis of the respective single yarns.

When the value of the twist of the fibers of the single yarns is about nought, owing to the resulting softness of the single yarns the most favorable condition is obtained for an increase in the surface of contact between the two yarns, for reciprocal permanent deformation, for mutual adaptation and for possible cooperation.

In the position the fibers of the two yarns, which are substantially parallel to each other and at the same time are wound spirally, reach an intimate contact, a thing hard to obtain with such a high total of values by means of the procedures of the prior art.

Therefore, the negative twist imparted to the single yarns has substantially the effect, at the moment when the twisting produces the effect of mutual compression, of making the fibers of the single yarns substantially parallel and therefore suitable not only for becoming plastic and for interacting with each other but also for being permanently deformed and providing the maximum surface of contact between the two yarns.

Hence it can be deduced that the action of retwisting the coupled yarns causes lengthwise tension in the single yarns since a length becomes required which is greater than the length permitted by the axially stationary braking points as this lengthwise tension generates an induced reciprocal thrust.

We have spoken of "braking", but this lengthwise action in relation to the splice can also be an action of opposition or of clamping which is and can be graduated as desired.

Hereinafter, therefore, by the words "braking" or "braked" we also mean all the alternatives indicated and also others which can be inferred.

The value of the lengthwise tension can be graduated by utilizing axially stationary braking means of a yielding type having a known and desired yield and also by varying in a suitable way the braking thrust acting.

This makes it possible to intercept or graduate a take-up of yarn from outside the axial braking points or zones and also to have a consequentially graduated and selected axial feed of the coupled zone.

This also makes it possible to obtain fibers made more parallel and also an elastic elongation of the fibers, or not, of a desired value.

Hence it can be deduced that the value of the negative twist to be imparted to the yarns before they are coupled depends, amongst other things, on the length of the splice and on the properties of the fibers and, among these, their elongation property (field of elasticity and field of permanent strain).

Indeed, it is necessary that, during the forming of the splice, desired percentages of fibers should never be exceeded either as regards elongation in the field of elasticity, elongation in the field of permanent strain or the breakage limit.

After the phase of intimate cooperation with substantially parallel fibers, a further twisting up to the desired value improves the splice and has the effect of imparting a positive twist to the single yarns as well.

The procedure for splicing the yarns according to the invention may entail the employment of twisting means so as to obtain joints suited to a particular purpose.

If we consider a device with facing rings (but the device could use belts, rotating end rings, cones, sliding surfaces, etc.) the twisting means may be counter-rotating facing disks with a suitable coefficient of friction in relation to the yarns to be jointed.

For the sake of simplicity only circular rotating rings and other means cooperating therewith, always of a substantially circular type will be considered. But it is to be understood that all the other equivalent means too can be employed instead of the above and are therefore included.

The twisting means may comprise plain surfaces or specially worked surfaces.

This special working may be embodied with operating means having a desired form such as, for instance, a form with circumferential sectors or a spiral or coil or others again, to suit the type of action (which may be tangential, tangential and axial, vibration, and so on) which it is wished to exert on the coupled zone.

The twisting means cooperate in pairs facing each other, and one of them advantageously rotates in the opposite direction to the other.

The twisting means may have the same or different diameters.

The twisting means may have the same kind of worked surfaces or different worked surfaces, or else one of them can be plain and the other can be worked.

The purpose of the specially worked operating means is to provide tangential and axial forces of desired value and direction during the retwisting phase.

Moreover, the twisting means serve to characterize the winding and to make it more uniform at the same time.

Furthermore, the twisting means serve to bring about compression forces which squash the fibers in the coupled zone and thicken them and reduce the diameter of the joint to the desired value.

The characterization of the winding permitted by the twisting means enables a desired winding slope of the coupled yarns to be obtained (slope of the winding spiral), so that the slope may be constant or variable or mixed, as desired and with the required properties.

The progression of the slope of the winding spiral starts at the middle of the splice and moves towards the edges thereof. This enables any requirements for an elasticity and/or strength differentiated from the middle to the periphery of the joint to be embodied to suit the needs of the usage means downstream.

A splice thus obtained according to the invention is already stable in itself, so that it is possible, as has been stated, to cut the tail ends of the yarns and leave a length thereof substantially free.

According to the invention, therefore, the action of cutting, plucking apart and/or tearing can be performed even when the splice has been made, and the tail ends thus remaining can be left free or be wound up with the means of the device or with other means envisaged for this purpose.

If it is wished to improve the splice, steps will be taken instead to perform cutting or plucking and/or tearing before the retwisting action makes the coupling too consistent.

The plucking and/or tearing action will find its own place, in respect of and in cooperation with the other phases, in relation to the length of tails ends which it is wished to obtain in proportion to the length of the zones spliced.

Thus, tail ends which are substantially short as compared to the length of the joint will permit a very broad working band within which the plucking and/or tearing phase can be fitted.

Long tail ends, which may reach a ratio of one to one in relation to the length of the joint, will only permit a very narrow working band since the phase is substantially performed in cooperation with the transitory moment of having fibers parallel to the axis of the advantageously substantially straight yarn.

According to a variant of the invention, when the tail ends are long and tapered, it is possible to apply the negative twist to a tract upstream from the zone involved in the plucking apart and/or tearing action (or else to a part of the zone involved in the plucking apart and/or tearing action).

In this case, if the means placed towards the point of the tail end to prevent the application of the untwisting is loosened, when coupling takes place, the two tracts which have not received a negative twist but are coupled become affected by the extension of the untwisting or part thereof towards them.

According to the requirements of the usage means downstream it is possible for the ends zones of the tails remaining after elimination of the excess tail ends to cooperate with the facing twisting rings or with the mechanical equivalents thereof.

In that case one shall have the position that the end zone of the tail of a yarn will be wound more or less tightly onto the other yarn owing to the pulling effect of the twisting rings.

It is also possible that the end zone of the remaining tails has to be held within the facing twisting rings or their mechanical equivalents.

In that case the winding on the other yarn will follow the twisting and one shall have a more or less tight splice depending on whether there are twisting means and in relation to the fact that the twisting means cooperate or otherwise in the zone or that at least one of the twisting means cooperates or not.

Where the twisting means cooperate with the zone of winding of the ends of the tails, the nature of the winding will depend on the conformation of the twisting means and on the configuration of the specially worked processing means.

The properties of the joint too will depend on the conformation and configuration of the twisting means.

In the case of certain usage means, when the single yarns are wound and having their fibers substantially parallel with approximately nil twists, it is possible to have a mechanical action of mutual penetration.

The mechanical action can be performed by processing with needles, pins, studs, etc. or with, or also with, jets of air.

The mechanical action may affect only the zone of the tails, or only the middle zone, or both of the zones according to an extent or lay-out desired.

The invention therefore embodies a splice between yarns, whether textile or otherwise, obtained by coupling single yarns by winding after the single yarns have been untwisted, the splice being characterized by comprising in at least one tract a number of twists in the coupled yarn which is about the same as the number of twists imparted to the single yarns after they have been coupled, whereby the single yarns comprise a negative twist greater than a nil value of twist at the time when they are coupled in a substantially parallel manner.

Moreover, the invention is realized with a procedure for the splicing of yarns, whether textile or otherwise, whereby the splice is obtained by coupling two single untwisted yarns and by re-applying twists thereafter, the procedure being characterized by the fact that the single yarns are untwisted beyond a substantially nil value of twist and are then coupled and retwisted until the single yarns have received a desired twist almost the same as the twists in the original yarn.

Other details and features of the invention will stand out from the description given below by way of non-limitative example and with reference to the accompanying drawings, in which:

FIG. 1 shows a splice according to the invention;

FIG. 2*a* shows a second embodiment of the splice of FIG. 1;

FIG. 2*b* shows a third embodiment of the splice of FIG. 1;

FIGS. 3*a*–3*c* show three respective reciprocal positions of the spliced yarns during the procedure of the invention;

Figure 11C:
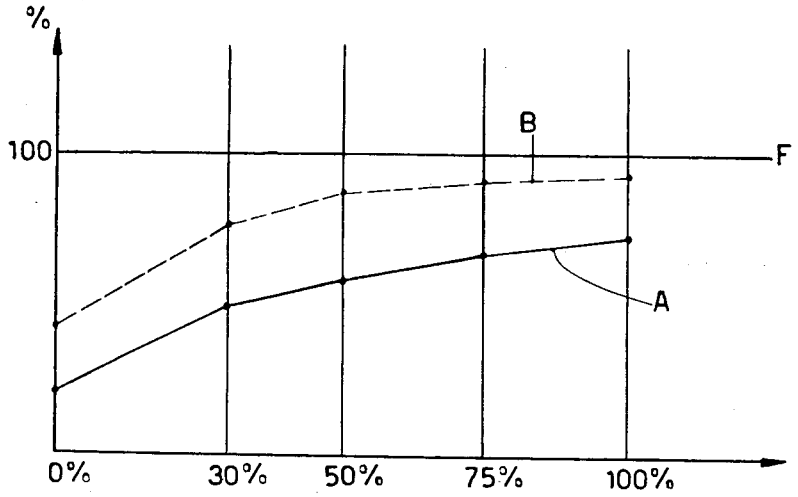
Figure 13:
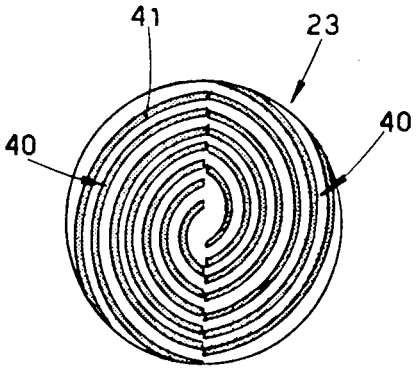
Figure 9A:
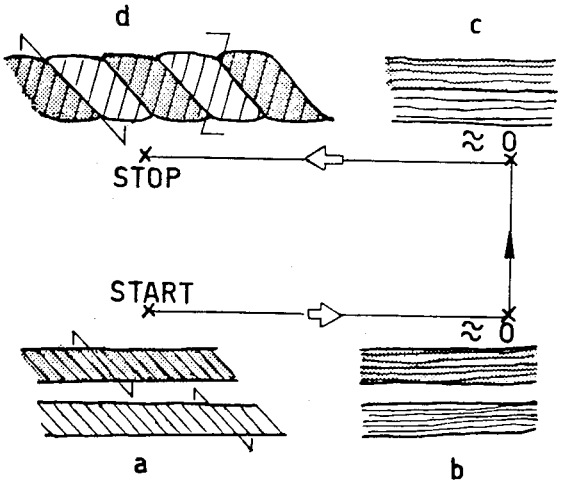
Figure 9B:
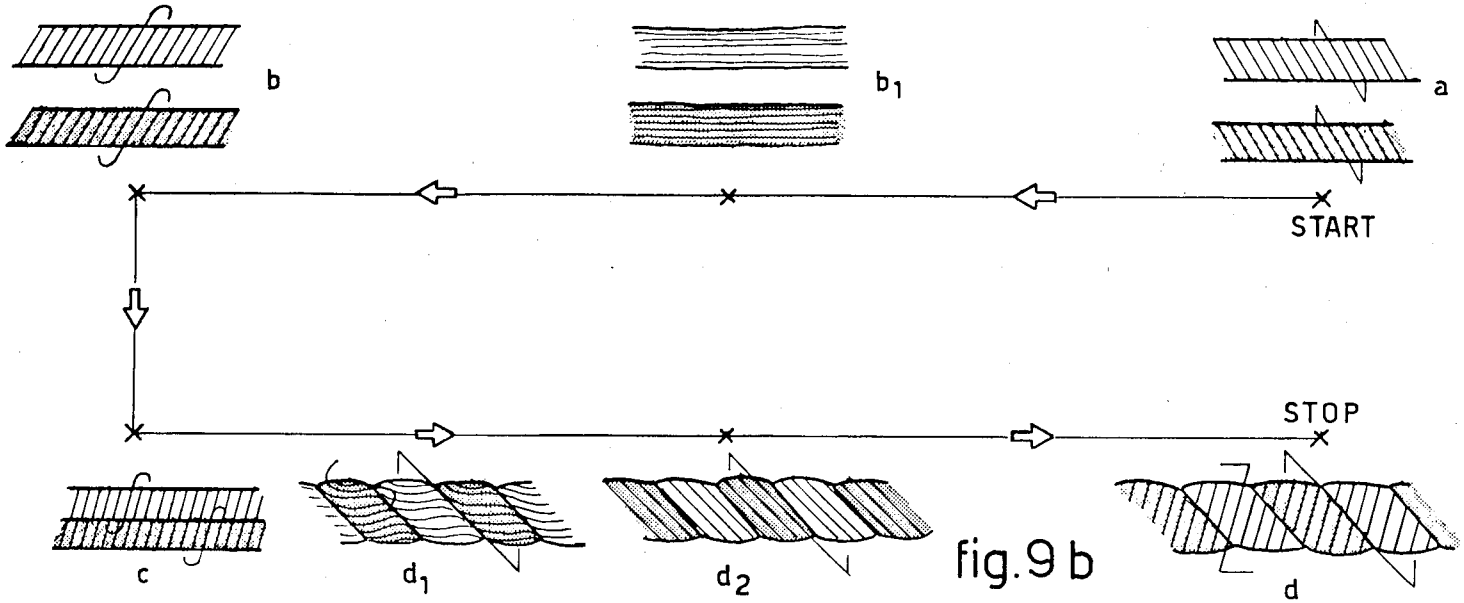
Figure 10B:
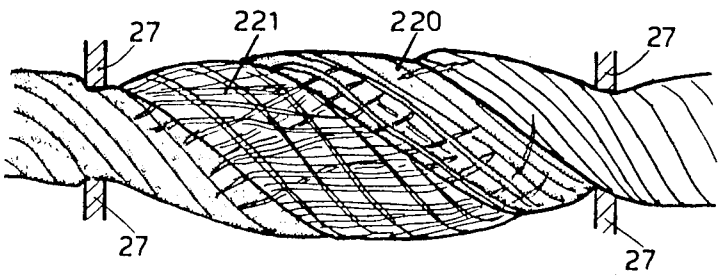
Figure 10A:
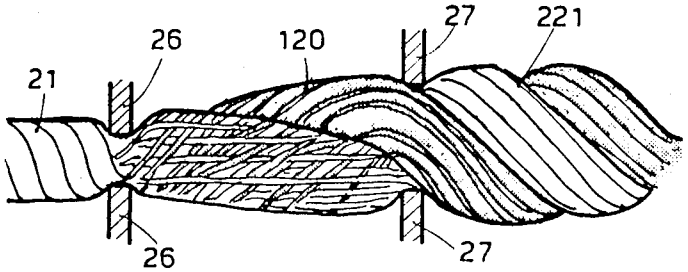
Figure 11A:
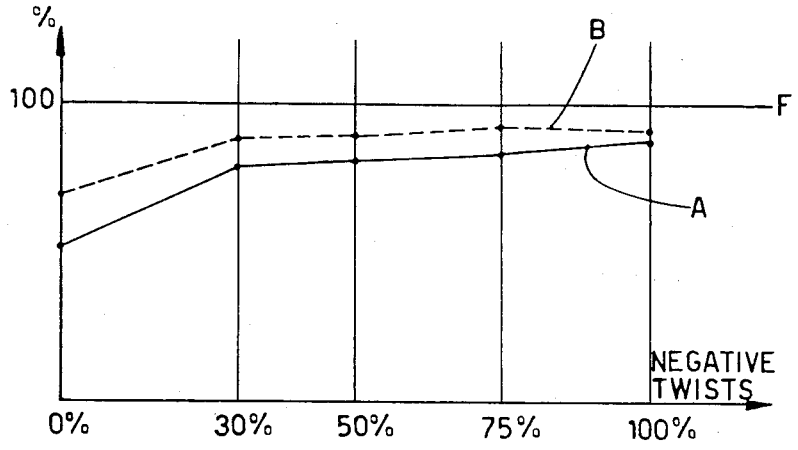
Figure 11B:
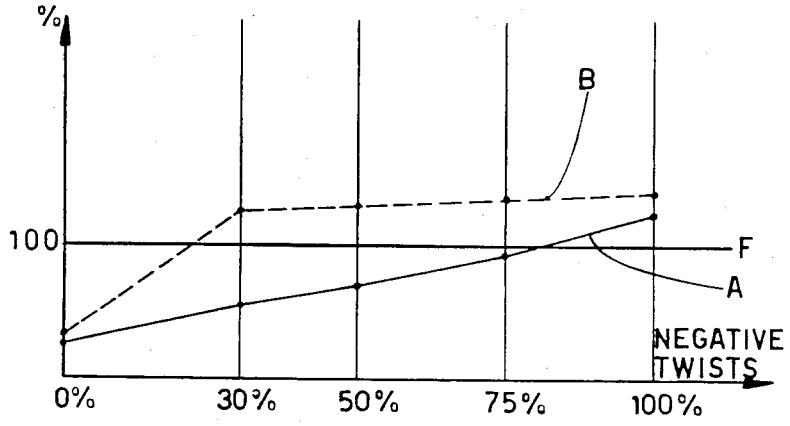
Figure 12:
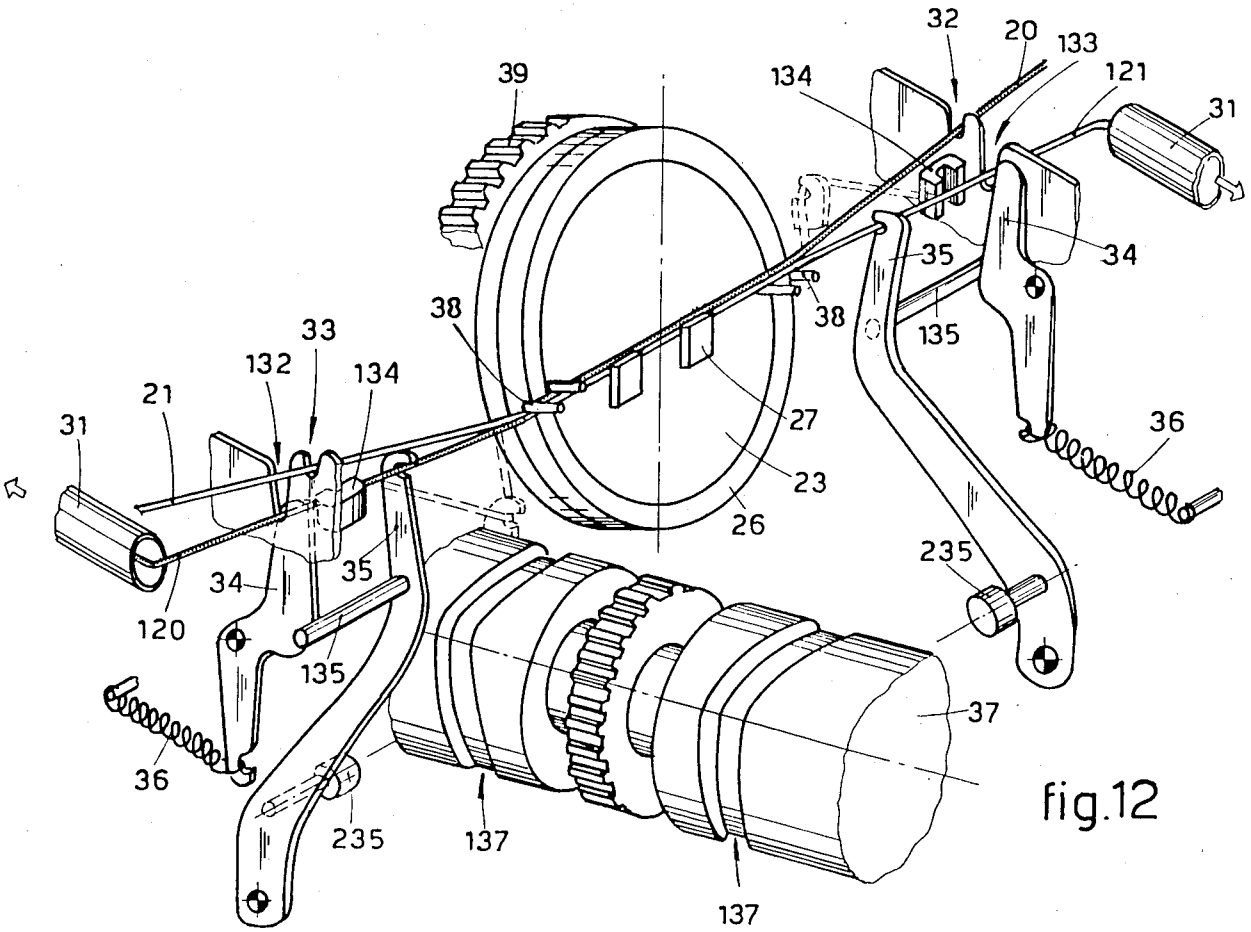

FIGS. 9*a* and 9*b* show the splicing procedure of the prior art and the procedure proposed by the invention;

FIGS. 10*a* and 10*b* show the effect of a possible auxiliary mechanical action of mutual penetration;

FIGS. 11*a*–11*c* show comparative graphs of splices obtained in various working conditions;

FIG. 12 shows diagrammatically a possible device suitable for carrying out the procedure of the invention;

FIG. 13 shows one type of twisting means.

With reference to the figures, the same parts or parts performing the same functions bear the same reference numbers.

As a non-restrictive example and with the help of FIGS. 9*a*–9*b*, let us analyse a comparison between the procedure of the prior art, which carries out untwisting to approximately a nil twist, coupling and then re-twisting (FIG. 9*a*), and the procedure of our invention, which carries out untwisting up to a desired negative twist, coupling and re-twisting (FIG. 9*b*).

The cutting or plucking apart and/or tearing of the tail ends is neither examined not placed in its proper order among the phases now so as to keep the description simple.

In both the procedures the starting condition is a follows:

single yarns with a Z twist;

X twists per unit of length of single yarn.

The procedure of the prior art (FIG. 9*a*) is as follows:

(a) cancellation of the twists; the single yarns are brought from X twists (position "a") to a value of about 0 twists per unit of length (position "b"); this approximate value may cover the imparting of an untwisting action which induces in the yarn a negative twist (in this case an S twist) having a value of up to about 5–10% of the positive twist (in this case a Z twist) present in the single yarn at the beginning, the purpose being to offset the natural deformation of the fibers;

(b) coupling: the yarns are coupled (position "c") and clamped at their ends; in this condition we have as follows:

twists of the fibers of the single yarns with a value of nought or almost nought;

twists of the coupled yarn with a value of nought;

fibers positioned substantially axially and parallel to each other or almost axially and parallel to each other;

the reciprocal thrust induced between the two single yarns when the fibers have a nil twist and are parallel to each other is passive or nil even in the presence of mechanical compression means in that the fibers transmit this thrust, if any, in a passive manner;

(c) retwisting: the single coupled yarns are retwisted together (position "d"), for instance, up to a number of twists the same as the initial number of twists of the single yarns.

The imparting of the twists to the coupled yarn has substantially the following outcome:

the twists of the fibers in the single yarns are substantially about equal to the twists imparted;

the twists of the coupled yarn are about equal to the twists imparted.

With such a procedure the reciprocal thrust as between the two single yarns is produced, in fact, only in the intermediate and final phases of the retwisting, even in the presence of a possible mechanical thrust.

The time most favorable for the effect of such an induced thrust is, instead, when the fibers are substantially parallel, that is, in the case of the cycle just seen, at the beginning of the retwisting (position "c"); otherwise the fibers of the two yarns do not enter into intimate cooperation and interaction but are substantially independent entities when retwisting has ended.

As an outcome, the characteristics of strength, elasticity, conformation, life, ability to be reproduced and appearance of the joint are not satisfactory.

To simplify the example the possible bonding effect generated by the possible superficial pulling of the fibers by the pressing means or twisting means has been overlooked.

The bonding effect generated by possible mechanical disturbing actions, which, in fact, create noteworthy problems, as has been stated earlier, has been left aside.

The procedure of the present invention (FIG. 9*b*) is seen in the following phases:

(a) untwisting of the single yarns until a substantial negative twist is obtained (we pass from position "a" to "b1" and then to "b"); this negative twist can have a value of from 15–20% up to more than 100% of the initial positive twist.

In this way both of the single yarns are brought from X twists (position "a") to 0 twist (position "b1") and then to minus W twists (position "b") per unit of length, that is to say, an S twist is imparted to yarns having a Z twist at the beginning, or viceversa.

(b1) coupling: after the untwisting action the yarns are put side by side and coupled (position "c") and the ends of the splice are clamped or braked; in this condition there is the following:

the S twists (Z twists at the beginning) of the fibers of the single yarns are minus W per unit of length;

the twists of the coupled yarn are nil;

(c1) retwisting continues up to about W twists per unit of length of the coupled yarn (passing through position "d1" and reaching "d2" with the fibers on about the axis of the single yarn), with the outcome that:

the twists of the fibers in the single yarns are cancelled and the single yarns have a twist of about nought, that is to say, they have their fibers positioned substantially parallel to the axis of the single yarns;

the twists of the coupled yarn, instead, are about W twists per unit of length; the fibers in the single yarns are parallel or almost so, to the axis of the yarns;

a reciprocal thrust exists which is induced between the two single yarns owing to the effect of reciprocal compression therebetween due to the retwisting of the coupled yarn and which deforms the mass of the fibers and creates substantially one single yarn composed of the two single yarns coupled together with parallel fibers;

(d1) retwisting of the coupled yarn up to Y twists per unit of length (position "d"); these Y twists correspond to X+W twists per unit of length (in fact the procedure was started with X twists, reached minus W negative twists and then restored all of the twists).

After Y twists have been imparted to the coupled yarn, there exists the following (position "d"):

the twists in the single yarns are about X in number per unit of length;

the twists of the coupled yarn are about Y in number (X+W) per unit of length.

In the third phase, owing to the positive twists imparted to the coupled yarns there are produced a reciprocal thrust induced between the two single yarns and an elastic desired tension acting between the yarns. This elastic tension and reciprocal induced thrust interact and create the desired bonding force, and this phenomenon can be accentuated by the fact that the result can also be produced by keeping the clamping points cooperating in the action, as already said. The bonding force is made optimal by the fact that the induced reciprocal thrust is already acting between the single yarns when they are comprised momentarily in the coupled tract of the splice with their fibers substantially parallel to the axis of the single yarns.

Hence it can be seen that the extent of untwisting beyond 0, namely beyond the moment when the fibers are parallel or substantially parallel to the axis of the single yarn, is a value which can be varied as wished to suit the type of yarn and what it is desired to obtain.

From experience acquired it seems that the following can be said:

the minimum value of untwisting from Z to S (or viceversa) shall be such as to ensure that, during the retwisting of the coupled yarns and when the yarns have their fibers momentarily substantially parallel to the axis of the single yarn, the induced reciprocal thrust between the yarns themselves is such as to create a sufficient and desired mutual anchorage as between the masses of fibers, which can thus enter into intimate contact;

the minimum value, which will depend on the type of yarn, the treatment undergone, the type of fibers and their properties, etc. will not be less than a number of negative twists equal to 15-20% (S twists when starting with Z twists) of the initial positive twists, but may rise to 30-50% (as a minimum value);

the maximum value of the untwisting or number of negative twists can even reach a number of S twists equal to 100% of the initial Z twists (or viceversa) but can also exceed this value greatly since the maximum value is conditioned by the number (better described as percentage value) of fibers which it is admitted may be broken in the single yarns during the whole splicing operation (untwisting plus retwisting).

The breakage of the fibers happens owing to the drawing action which the fibers themselves undergo during the retwisting operation, the drawing action being generated by the lengthwise elongation which the single yarns undergo in the operation. When this drawing action surpasses the elastic limit of the fibers, with or without a lack of sliding of the fibers, it leads either to permanent deformation of the fibers or to their breakage, depending on the value of the drawing action.

Figure 5:
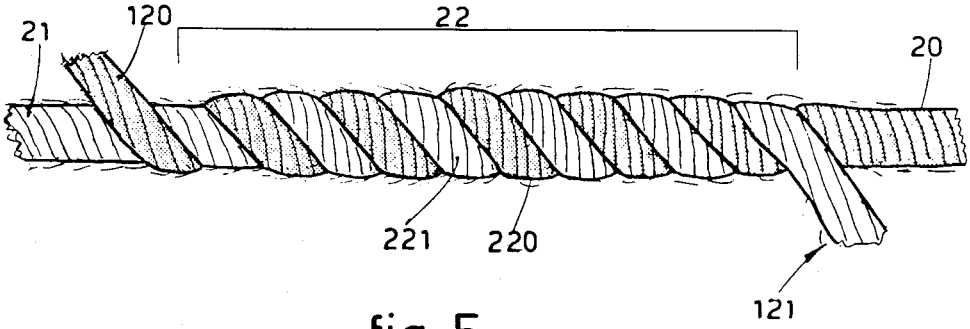
FIG. 5 shows a fourth embodiment of the splice of FIG. 1 with the tail ends cut or torn and free.

With the procedure of present invention a splice 22 according to FIG. 5 with the tail ends 120 and/or 121 free (cut or torn as in the example shown, or plucked apart) is stable enough and can be employed without any worry in given operations downstream.

Figure 6:
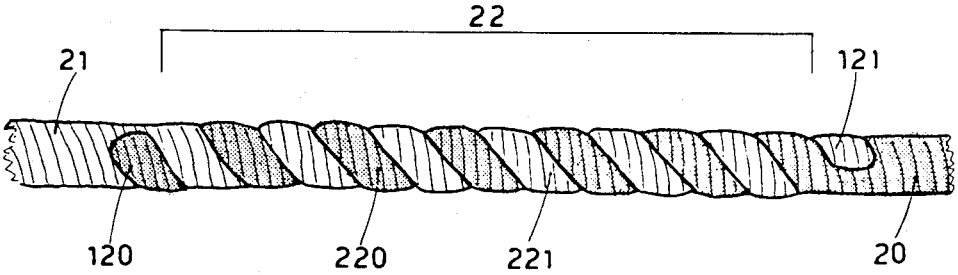
FIG. 6 shows a fifth embodiment of the splice of FIG. 1 with the tail ends cut or torn and wound up.

If steps are taken to wind up (FIG. 6) the tail ends 120 and/or 121 respectively on the yarns 21 and 20, a still stronger splice is obtained.

The winding of the tail ends 120,121 is performed with the same device as that which is used to make the splice 22, or with other suitable means.

If the device is equipped with retwisting means 23 (see FIG. 12 and FIG. 13, wherein the retwisting means are shown as being circular), besides the effects which one shall see further on there is also created a superficial slithering of the fly fibers 24 (FIG. 4), which anchor themselves with their end points 124 onto and with the other fibers, thus creating a better anchorage and bonding of the single yarns 20,21 either to each other or to other coils of themselves by passing over the other yarn.

According to the procedure, in a phenomenon which is shown in the case of tail ends plucked apart (FIGS. 1-2 and 4), the tail ends 120,121 are wound tightly onto the other single yarn 21,20 respectively, so that the last coils of the winding become protected by the protrusion of the face of the single yarn onto which they are wound.

Figure 4:
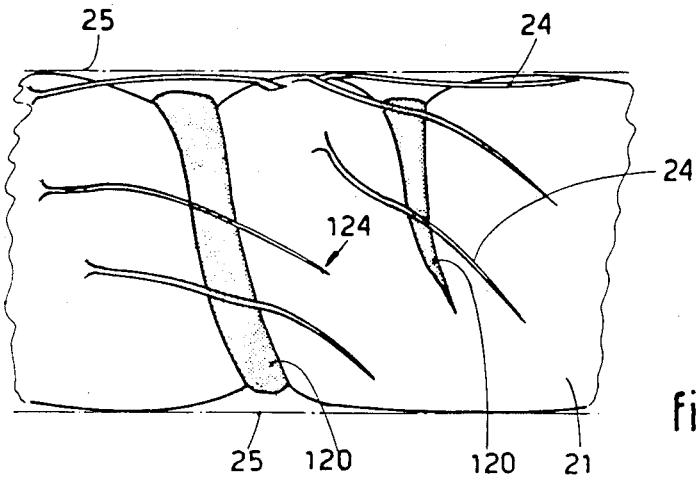
FIG. 4 shows diagrammatically the splicing effect of the procedure.

FIG. 4 shows this phenomenon for instructional purposes. Therein the face 25 of the coils of the yarn 21 is deeply furrowed by the coils of the tail end 120 so that the coils of the tail end 120 are contained within the outside 25 of the yarn 21.

According to the procedure it is possible to have different types of joints with different properties in relation to the inclusion or otherwise of retwisting means 23, to the type and the combining of types of the retwisting means 23, to the distance of the retwisting means 23 from the retwisting rings 26, to the pressure of the retwisting rings 26, to the pressure of the retwisting means 23 and to the working pressure of the clamping means.

The means for braking and/or opposing and/or clamping the lengthwise sliding of the yarn, as indicate earlier, can consist of retwisting rings 26, retwisting means 23 or clamping means 27 or of the cooperation of two or more thereof.

Figure 1:
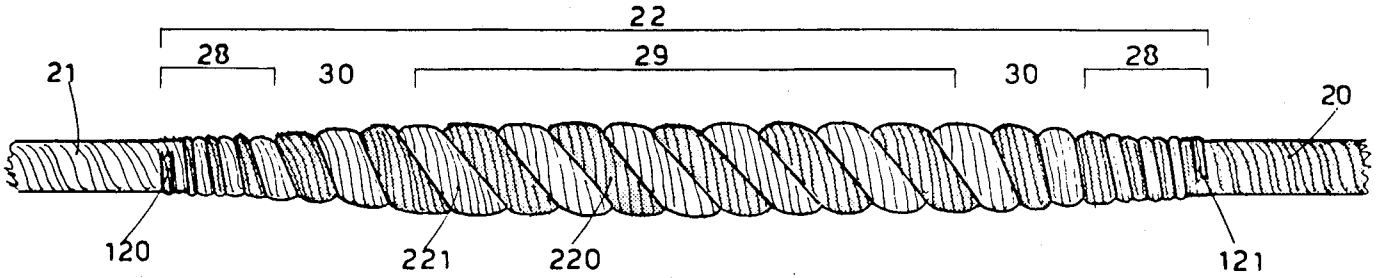

FIGS. 1, 2, 7 and 8 show some type of splices. The splice of FIG. 1 is obtained without retwisting means 23 and with plucked tail ends 120,121 the end zone of which does not cooperate with the retwisting rings 26 (but it is possible to obtain joints in which the plucked tail ends cooperate at least partly with the retwisting rings 26).

In these conditions the splice 22 consists essentially of three zones, respectively a middle zone 29 with an almost constant development of the coils, a transition zone 30 in which the coils change their slope progressively while the diameter of the splice decreases progressively, and a zone for bonding the tail ends 28 wherein the slope of the coils changes more quickly than in zone 30.

The action of opposing the lengthwise sliding of the single yarns to feed the joint can be carried out in this case by the retwisting rings 26 themselves.

This type of splice can have in zone 29 a maximum diameter varying between 1.25 and 1.8 times the diameter of the single yarn, whereas in zone 28 the maximum diameter may vary instead between 0.8 and 1.25 times the diameter of the single yarn.

The splices of FIG. 2 were obtained by fitting the retwisting means 23 to the device.

The retwisting means 23 can not only characterize the conformation of the coils in the joint, thicken the fibers, pull the fibers superficially, etc. but can also act as means to brake the lengthwise sliding of the single yarns to feed the splice.

Figure 2A:
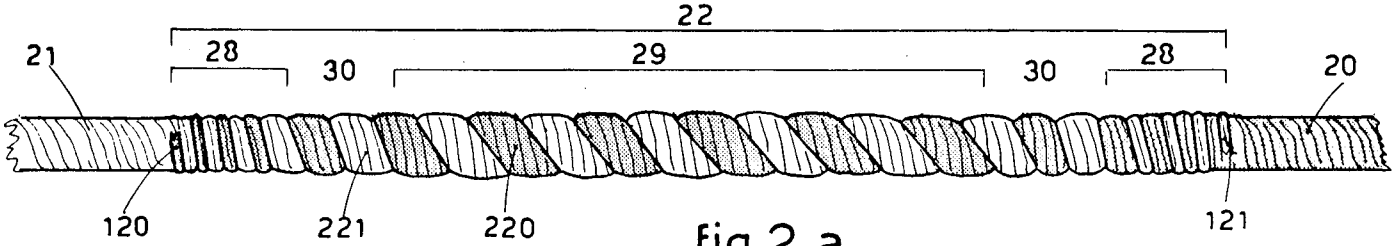

In the case of FIG. 2*a* (the fly fibres 24 have been purposely not shown so as to keep the example clear) there will still be three zones but zone 29 will take up a proportionately greater length. This type of splice can have a maximum diameter in zone 29 about 1.05 to 1.25 times the diameter of the single yarn.

Figure 2B:
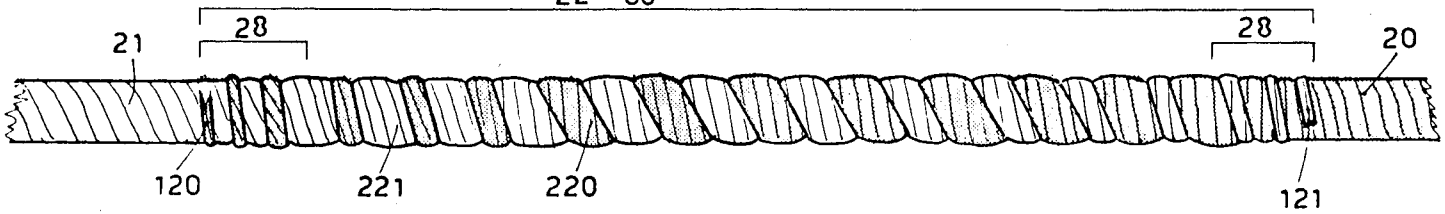

FIG. 2*b* shows a case wherein the tail ends are about as long as the splice, fibers being evenly spread out in the tail ends.

In such a case the splice 22 still has a zone 28 for the splicing of the tail ends, but zone 29 is substantially lacking, while the transition zone 30 practically covers zone 28 too.

It can be seen from that figure that in such a case a bond is produced in practice with a mutual progressive development in both directions.

The type of splice has a diameter between 0.8 and 1.10 times the average diameter of the single yarn, and the diameter may vary substantially within the limits along the axis of the splice.

Different splices will be obtained by varying the length of the tail ends and, where retwisting means 23 are included, will be a combination of the joint of FIG. 2*a* and that of FIG. 2*b*.

FIG. 3 show different conditions of single yarns 20,21 and of the splice.

Figure 3A:
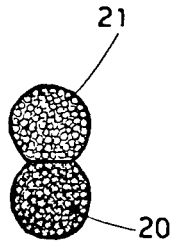

FIG. 3*a* shows the single yarns in position "c" (yarns untwisted and coupled) of FIG. 9*b*.

Figure 3B:
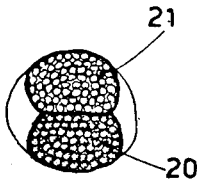

FIG. 3*b* shows the single yarns interacting owing to the reciprocal induced thrust when they are in position "d2" of FIG. 9*b* (single yarns with parallel fibres but coupled and twisted together).

Figure 3C:
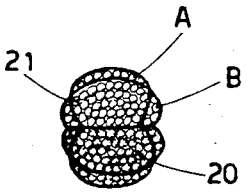

FIG. 3*c* shows two last conditions of the single yarns with the splice made (middle zone 29) respectively with retwisting means 23 (position "B") and without retwisting means 23 (position "A").

This figure shows the further bonding effect created by the inclusion of the retwisting means 23.

Besides varying the characteristics of the joint, as can be seen hereinafter, the retwisting means 23 can also impart different appearances and conformations to joints.

Figure 7:
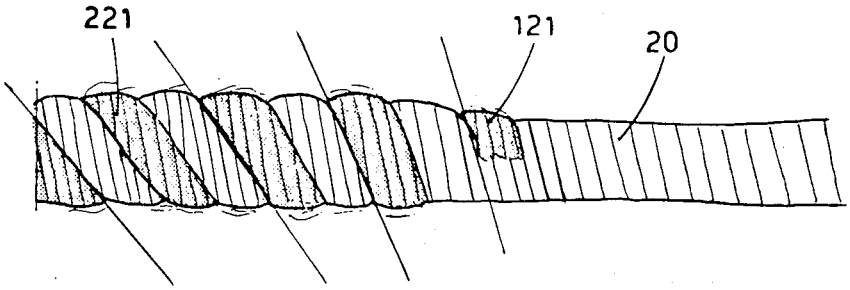
FIGS. 7 and 8 show two possible arrangements of the yarns in the splice.
Figure 8:
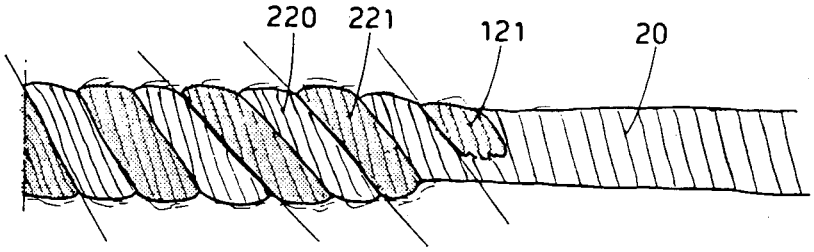

FIGS. 7 and 8 are two indicative examples. The tail ends 120,121 are shown without any relation to specific cases.

The coils in FIG. 7 tend progressively to take up a position more at right angles to the axis of the single yarn the farther they are distanced from the middle towards the end of the splice.

In FIG. 8, instead, the coils are oriented at about right angles to the axis of the splice near the middle of the splice and then vary progressively, reaching the outside end thereof with an accentuated slope.

As stated earlier, these two examples are indicative of what can be obtained by acting on the conformation of the retwisting means 23, on the combinations of various kinds of retwisting means 23 and on the dimensional ratio between the two retwisting means 23 themselves and between the retwisting means 23 and the retwisting rings 26, and therefore are indicative of the different special forms of joint which can be obtained.

FIG. 10 show diagrammatically the effect which can be obtained by mechanical ruffling means which make the fibers penetrate mutually and interact in addition to the induced thrust described earlier.

The mechanical ruffling means can consist of pins, combs, studs, punches, brushes, etc. or else jets of air, acting alone or jointly.

The end fibers of the tail end 120 in FIG. 10*a* are at least partially mingled with the fibers of the single yarn 21.

The fibers of the wound single yarn 220,221 in FIG. 10*b* are at least partially mingled with the fibers of the other single yarn 221,220.

The mechanical and/or pneumatic mingling action of the ruffling means according to the invention is advantageously started at about position "d2" of FIG. 9 when the fibres are parallel or substantially so in the single yarns 20,21 wound together 220,221.

FIG. 12 shows diagrammatically and essentially a device able to perform the procedure of the invention. The component parts have been deformed so as to show their working and also their mutual positioning better.

The device of FIG. 12 is indicated for descriptive simplicity but other devices too when suitably adapted could be employed to carry out the procedure.

Thus, instead of the facing rings 26 is it possible to use facing belts or cones or rollers or contrasting sliding surfaces or else other equivalent types suitable for providing the desired untwisting and the retwisting thereafter.

In the device given as an illustration in FIG. 12 the yarns 20,21 are put in the positioning lodgements 32,33 and their tails cooperate with withdrawal conduits 31.

When the single yarns 20,21 have been put in the lodgements 32,33, they are placed between two retwisting rings 26 and are untwisted to the desired value and then coupled together with the help of coupling means 38.

In FIG. 12 the coupling means 38 are solidly fixed to the retwisting rings 26 but could be independent and work independently.

As soon as the yarns 20,21 have been coupled, they can be clamped with the help of clamping means 27 and of the clamping lever 34 which cooperates with the clamping stop plate 134 or with other suitable clamping means. The lever 34 is resisted by the spring 36 in an elastic manner.

The distance of the clamping means 27 from the inner edge of the twisting rings 26 can be greater than or the same as the average length of the fibers or be less than the average length of the fibers.

When the yarns 20,21 have been clamped, the plucking and tearing lever 35 (which governs the lever 34 by means of the pin 135) owing to its linkage to the cam 37, which by means of the path 137 conditions the roller 235 solidly fixed to the lever 35, plucks apart the tail end 120,121 of the yarn 20,21 rispectively.

This plucking, which may be replaced or integrated with a tearing and/or cutting action, is able to obtain a remaining tail 120,121 which diminishes and is progressive and of which the bigger section is near the clamping means 27.

When the plucking and/or tearing has been done, the lever 34 frees the tail, which is aspirated by the withdrawal conduits 31.

The phases are indicated diagrammatically and according to an instructive sequence.

Steps are taken next to carry out the action of retwisting the coupled yarns 20,21 by means of the retwisting rings 26 and perhaps also with the help of the retwisting means 23.

At least one of the retwisting rings 26 is axially movable and both of them can be made to rotate by gear wheel means 39.

The retwisting means 23 are disks located within and coaxial to the untwisting-retwisting rings 26. Such retwisting means 23 act during the retwisting step alone with an action which, in cooperation with the action exerted by the untwisting-retwisting rings 26, extends substantially along the whole length of the splice. Such action makes it possible to obtain a perfect control of the coupled yarns, a greater compaction of the fibers and a surface drawing of the surface of the splice.

The retwisting means can both be able to move in relation to the two retwisting rings 26, or else one retwisting means 23 can be able to move in relation to the corresponding ring 26, while the other retwisting means 23 can be stationary. The retwisting means 23 can have the same diameter as each other or a different diameter.

The reciprocal pressure (working pressure) which the retwisting means 23 can apply is a pressure which can be controlled at all times and can be graduated in value as required.

The retwisting means 23 can both have the same surface configuration (namely the configuration which exerts its effect on the splice), or one retwisting means 23 can have one configuration while the other can have another configuration. The surface configuration will depend on the type of effect to be obtained on the splice and therefore can be flat or can comprise processing means 41.

The processing means 41 are just segments, or sectors, or ridges, or variations of the surface conformation or variations of the material composing the surface with which such retwisting means are provided, as can be seen in FIG. 13 for instance. The processing means 41 carry out an action of drawing the surface of the fibers not only tangentially but also with a mixed tangential-axial action. In this way it is possible to obtain better cooperation between the fibers of the two yarns and produce the effect of making the splice compact and obtaining a better bond through the surface hairiness of the two yarns.

Moreover, it is impossible with these processing means 41 to obtain a surface action on the yarns with a progressive development, for instance from the center towards the periphery of the splice or from the periphery to the center in correlation with the properties of compactness and/or volume required for the splice itself.

All this set of variables is necessary to meet the manifold requirements of the splices, for such requirements vary with different counts of yarns or with different materials constituting the fibers. The correct choice and combination of such variables forms the secret know-how of the owner of the patent rights.

As is known, the retwisting rings 26 and retwisting means 23 work in facing pairs rotating in opposite directions.

The retwisting means 23 shown is divided into two substantially equal surfaces 40 positioned alongside each other along a diameter.

The surfaces are conformed with processing ridges 41 able to produce an action of superficial displacement on the coupled yarn within the spirit of the invention and in addition to an action of pressure and rotation.

Said action of superficial displacement not only acts on the fly fibers 24, but also acts on the coils and body of the joint and conforms the body as wished, as we said before.

FIG. 11 show the following respectively:

in FIG. 11*a*, the average strength of the single yarn compared to the average strength of the yarns forming a splice made with differing processing conditions, with a comparison of joints (line "A") made without retwisting means and joints (line "B") made with retwisting means;

in FIG. 11*b*, the average number of blows needed to break respectively a single yarn and yarns forming the two kinds of joint made, once again, with the processing conditions of FIG. 11*a;* in FIG. 11*c*, the minimum strengths of the yarns and of the spliced yarns.

The tests were conducted with a yarn of carded cotton Ne 16/1 on standardized lengths of 500 mm. which contained the joint.

The figures give comparative conditions and serve to show the improvements obtained with the invention.

It can be assumed that further advantages can be obtained with a definitive (industrial scale) device and with other retwisting rings 26 and retwisting means 23.

The curves "A" show tests conducted with the retwisting rings 26 alone, whereas the curves "B" indicate tests performed with the retwisting means 23 too.

The lines F serving to provide the comparison show the average values found in the single yarns.

The conditions of the untwisting of the single yarns before the coupling are shown horizontally.

Said untwisting conditions are respectively:

0% indicates splices made with the technique which untwists to a value of about nought, that is, obtaining substantially parallel fibers before the coupling;

30% indicates splices obtained by untwisting the single yarns to a minus W value which corresponds to minus 30% of the twists originally present in the single yarns;

50% indicates splices obtained by untwisting the single yarns to a minus W value which corresponds to minus 50% of the twists originally present in the single yarns;

75% indicates splices obtained by untwisting the single yarns to a minus W value which corresponds to minus 75% of the twists originally present in the single yarns;

100% indicates splices obtained by untwisting the single yarns to a minus W value which corresponds to minus 100% of the twists originally present in the single yarns.

In each case steps were taken to impart X+W twists to the coupled yarn, as in the example of FIG. 9*b*.

The braking pressures during the tests were kept high. The retwisting rings 26 and retwisting means 23 were always kept the same.

FIG. 11*a* shows that the inclusion of the retwisting means 23 in the case of joints made without untwisting beyond a nil twist or with a low value of negative twists offsets partially the low value of untwisting and raises the strength properties.

FIG. 11*b* shows how the inclusion of the retwisting means 23 raises the properties of resistance to blows.

The minimum strength too (FIG. 11*c*) benefits by inclusion of the retwisting means 23.

The properties resulting from a considerable untwisting (beyond minus 50%) seem to flatten out, but it appears that this flattening can be blamed on the means employed in the tests.

The invention has been described here according to preferential solutions shown as examples, but variants, integrations and combinations can be embodied by a technician in this fields, with the use also of mechanical equivalents, without departing thereby from the scope of the invention.

We claim:

1. A procedure for splicing yarns comprising separately untwisting positively twisted individual yarns beyond a substantially nil twist to a negative twist of at least 15% of the original positive twist, coupling said negatively twisted individual yarns to form a coupled tract, retwisting said coupled yarns to form single twisted yarns until said negative twist in each yarn is eliminated and the fibers in each yarn are parallel and continuing to retwist said yarns so as to impart to the single twisted yarns a twist almost the same as the positive twist comprised in the original positively twisted individual yarns.

2. The procedure of claim 1, wherein the untwisting phase is carried on beyond the nil value until a negative twist value has been imparted which is equal to 15–20% of the initial positive twist value comprised in the twisted single yarns, said twisting of the coupled yarns to where the negative twist is eliminated and the fibers in each yarn are parallel inducing a reciprocal thrust.

3. The procedure for splicing yarns as in claim 1, wherein the untwisting phase is carried on beyond the nil value until a negative twist value has been imparted which is equal to at least 15–20% of the initial positive twist value comprised in the individual yarns, the negative twist value being applied being dependent on the property of elongation of the fibers.

4. The procedure for splicing yarns as in claim 1, wherein the retwisting after the coupling phase is carried out with retwisting rings.

5. The procedure for splicing yarns as in claim 1, wherein the retwisting after the coupling phase is carried out with the cooperation of retwisting rings together with retwisting means.

6. The procedure for splicing yarns as in claim 1, including the step of forming tail ends and cutting the tail ends of the yarns when splicing has ended.

7. The procedure for splicing yarns as in claim 1, including the step of cutting, tearing and/or plucking apart the yarns to form tail ends during the splicing procedure.

8. The procedure for splicing yarns as in claim 1, including the steps of forming tail ends and winding with retwisting rings the tail ends of the yarns.

9. The procedure for splicing yarns as in claim 1, including the steps of forming tail ends and winding the tail ends of the yarns with retwisting means.

10. The procedure for splicing yarns as in claim 1, including the steps of forming tail ends and winding the tail ends of the yarns through cooperation of retwisting rings and retwisting means in said tract with the retwisting means being movable relative to at least one retwisting ring.

11. The procedure for splicing yarns as in claim 1, including the steps of lengthwise feeding the coupled yarns in said coupled tract and braking at least part of the coupled tract during at least part of the retwisting phase.

12. The procedure for splicing yarns as in claim 1, including the step of an auxiliary action of mechanical and/or pneumatic mutual penetration during the retwisting phase on at least part of the said coupled tract.

13. The procedure for splicing yarns as in claim 1, including the steps of compressing and thickening the splice with the help of the retwisting means after the coupling and during the retwisting phase.

14. The procedure for splicing yarns as in claim 1, wherein after coupling and during the retwisting phase an action of thrust is created on the splice starting from a midzone of the splice and moving towards its ends.

15. The procedure for splicing yarns as in claim 1, including the steps of lengthwise pulling fly fibers of the splice from a midzone of the splice towards its ends and thrusting the fly fibers towards the fibers of the single yarns after the coupling and during the retwisting phase.

* * * * *